US011029123B1

(12) United States Patent
Andersen

(10) Patent No.: US 11,029,123 B1
(45) Date of Patent: Jun. 8, 2021

(54) HOBBY PROJECTILE

(71) Applicant: Matt Andersen, Omaha, NE (US)

(72) Inventor: Matt Andersen, Omaha, NE (US)

( * ) Notice: Subject to any disclaimer, the term of this patent is extended or adjusted under 35 U.S.C. 154(b) by 0 days.

(21) Appl. No.: 16/393,248

(22) Filed: Apr. 24, 2019

(51) Int. Cl.

| | |
|---|---|
| ***A63B 65/02*** | (2006.01) |
| ***F41B 7/08*** | (2006.01) |
| ***A63H 33/18*** | (2006.01) |
| ***F42B 6/00*** | (2006.01) |

(52) U.S. Cl.
CPC ..... *F41B 7/08* (2013.01); *A63H 33/18* (2013.01); *F42B 6/003* (2013.01)

(58) Field of Classification Search
CPC ..... F42B 6/003
See application file for complete search history.

(56) References Cited

U.S. PATENT DOCUMENTS 5,016,888 A * 5/1991 Huston ..... A63F 3/00694 273/239
5,587,102 A * 12/1996 Stern ..... C09D 5/00 252/62.54
5,775,694 A * 7/1998 Jonsson ..... F42B 6/003 273/348.3
5,843,329 A * 12/1998 Deetz ..... G09F 7/04 252/62.54
7,018,557 B2 * 3/2006 Redding ..... C09D 5/00 239/337
7,775,918 B2 * 8/2010 Tsang ..... F42B 6/10 473/572
9,441,926 B1 * 9/2016 Bond ..... F42B 6/08
2007/0029732 A1 * 2/2007 Herrmann ..... A63B 67/00 273/348.3
2007/0080498 A1 * 4/2007 Yiu ..... F42B 6/003 273/348.3
2007/0087873 A1 * 4/2007 Yiu ..... F42B 6/003 473/578

* cited by examiner

*Primary Examiner* — John A Ricci
(74) *Attorney, Agent, or Firm* — Suiter Swantz pc llo

(57) ABSTRACT

A toy projectile, such as a dart, ball or disc has a magnetic or magnetizable component associated therewith to facilitate the collection of toy projectiles which may be scattered on a floor or on the ground. A telescopic wand having a metal or magnetizable component may be used to pick up the toy projectiles.

24 Claims, 5 Drawing Sheets

HOBBY PROJECTILE

BACKGROUND OF THE INVENTION

Field of the Invention

This invention relates to a hobby or toy projectile such as a dart, disc or ball. More particularly, this invention relates to a toy projectile, such as a toy dart, having a metal object embedded in the tip or shaft of the toy dart. Even more particularly, the invention also relates to a toy dart having a magnetic or magnetizable tip. Still more particularly, the invention relates to a toy projectile, such as a dart with a magnetic or magnetizable coating, which is dipped or sprayed onto the tip and/or shaft of the toy dart. Yet more particularly, the invention relates to a toy projectile which has magnetic or magnetizable particles or fibers embedded therein.

Description of the Related Art

Toy projectiles, such as darts, discs or balls, have become very popular, especially with children. The toy projectiles are thrown or shot at targets or other persons. In many cases, there will be many toy projectiles scattered on the ground or floor which makes it difficult for them to be picked up especially when they are located beneath furniture or the like.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A toy projectile, such as a dart, disc or ball, has a magnetic or magnetizable material associated therewith to enable the toy projectiles to be easily gathered up or picked up by a telescopic wand. In one embodiment of the toy dart, the tip thereof has a metal inner end. In another embodiment, the tip of the toy dart has magnetic or magnetizable particles or fibers embedded therein. In another embodiment, the shaft of the toy dart has magnetic or magnetizable particles or fibers embedded therein. In another embodiment, the tip of the toy dart is coated with a magnetic or magnetizable material. In another embodiment, the shaft of the toy dart is coated with a magnetic or magnetizable material. In another embodiment, the tip and the shaft of the toy dart are coated with a magnetic or magnetizable material.

Other toy projectiles, such as balls or discs have magnets or magnetizable materials associated therewith in a similar fashion as described hereinabove. A telescopic wand, having a metal or magnetizable head thereon, is utilized to pick up or gather up the spent toy projectiles.

It is therefore an object of the invention to provide toy projectiles with metal, magnets or magnetizable material to enable them to be picked up by a metal or magnetic wand.

A further object of the invention is to provide toy projectiles with a magnets or magnetizable material which does not affect the flight of the toy projectiles.

Yet another object of the invention is to provide toy projectiles of the type described which are safe to use.

Still another object of the invention is to provide toy projectiles of the type described which are economical of manufacture and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 2:
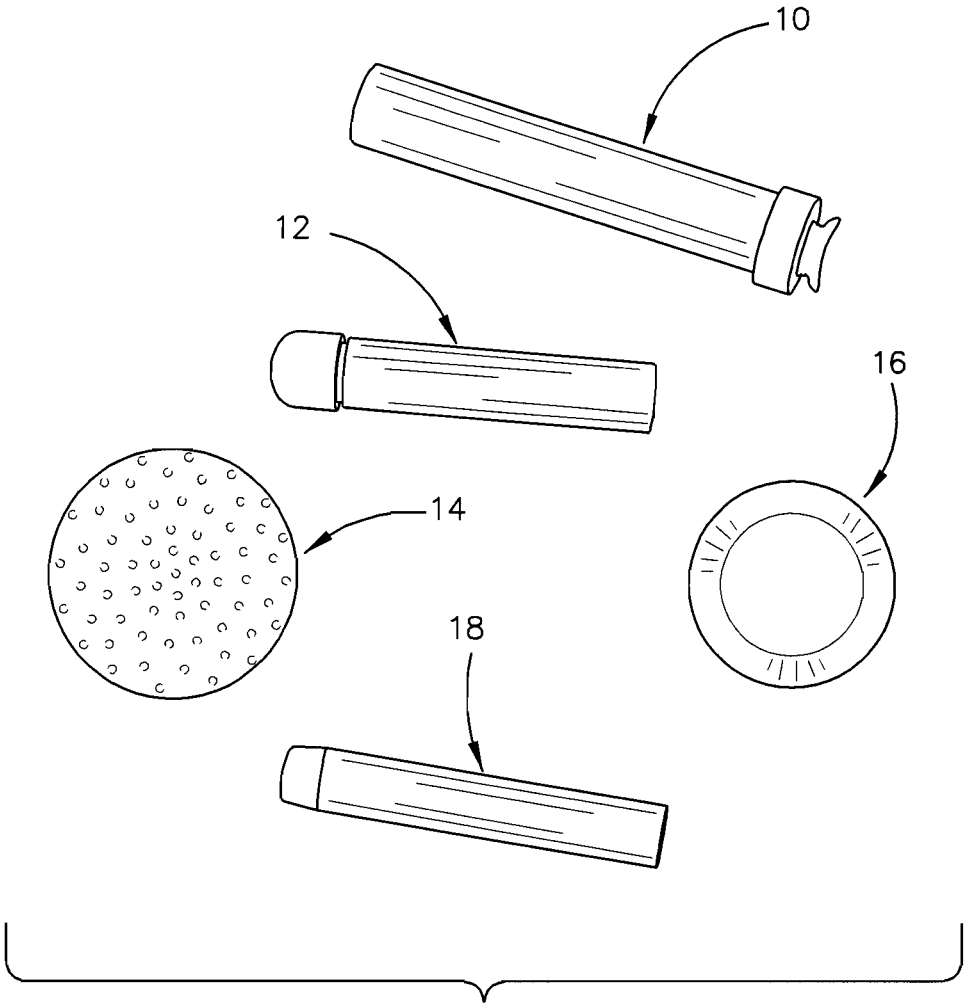
FIG. 2 is a view which illustrates different toy projectiles.
Figure 3:
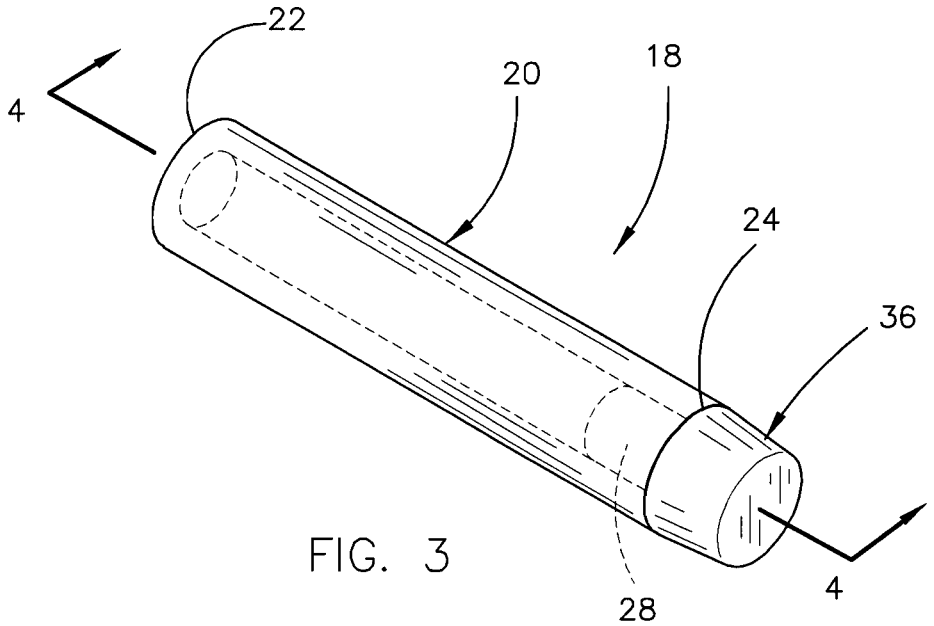
FIG. 3 is a perspective view of one embodiment of the toy dart of this invention with the broken lines depicting the inner end of the dart tip and the central bore of the dart tip.
Figure 4:
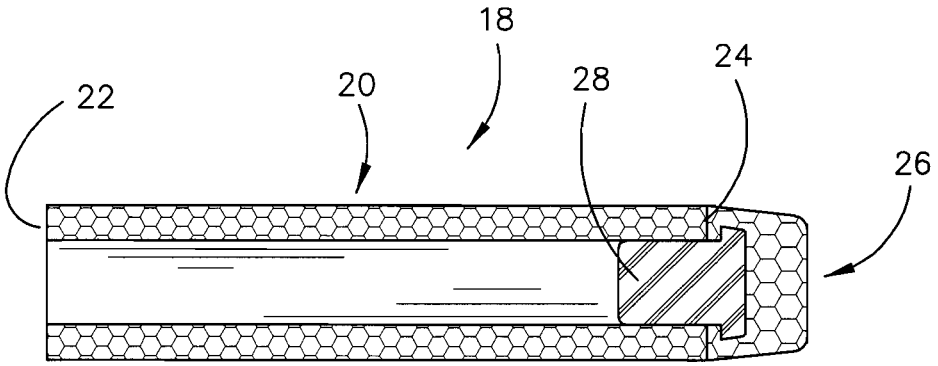
FIG. 4 is a sectional view of the toy dart of FIG. 3 as seen on lines 4-4 of FIG. 3.

FIG. 2 illustrates different types of toy projectiles or darts which are shot from a toy pistol or toy rifle. The numeral 10 refers to a suction dart while the numeral 12 refers to a mega dart. The numeral 14 refers to a rival ball while the numeral 16 refers to a vortex disc. A standard dart is designated with the numeral 18. The standard dart 18 includes a tubular body portion 20 having a rearward end 22 and a forward end 24. Body portion 20 is normally comprised of a foam material. Dart 18 includes an elastomeric tip 26 which is held in place by a shank portion 28 which is normally comprised of an elastomeric or plastic material.

Figure 5:
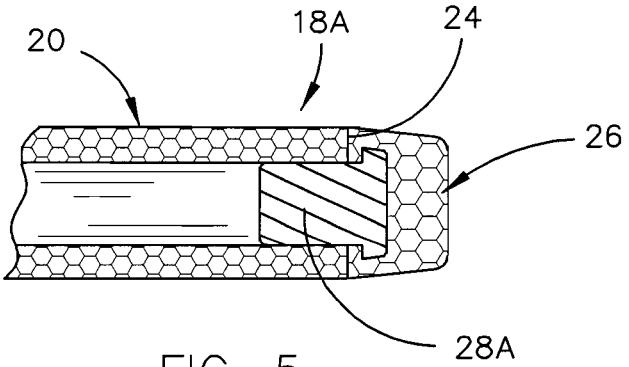
FIG. 5 is a partial sectional view of a further embodiment of the toy dart wherein the inner end of the tip of the dart is comprised of metal.

FIG. 5 illustrates a first embodiment of the dart 18. In dart 18, the shank portion 28A is comprised of a magnetic or magnetizable material. Shank portion 28A could be comprised of a metal material.

Figure 6:
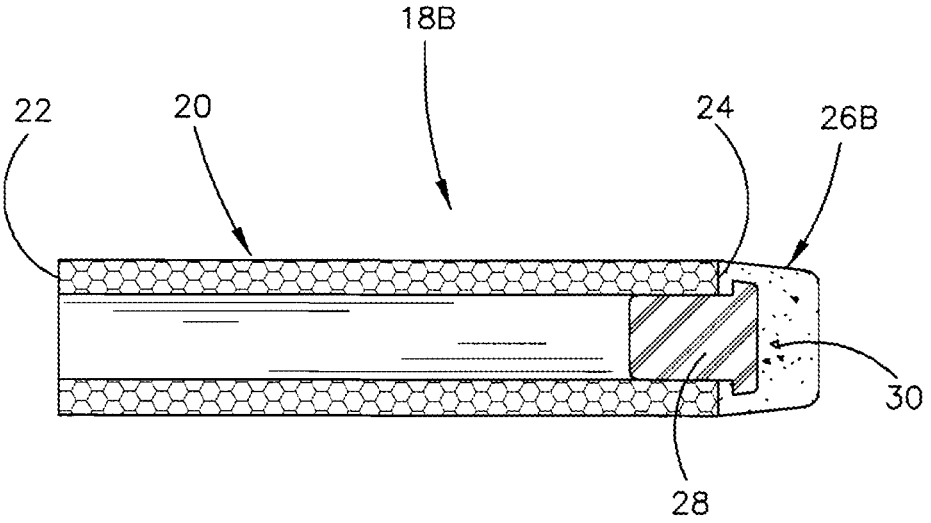
FIG. 6 is a sectional view of a further embodiment of a toy dart wherein the tip thereof has magnetic or magnetizable particles or fibers embedded therein.

FIG. 6 illustrates a second embodiment of the dart and is referred to as dart 18B. The tip 26B of dart 18B has magnetic or magnetizable particles 30 embedded therein.

Figure 7:
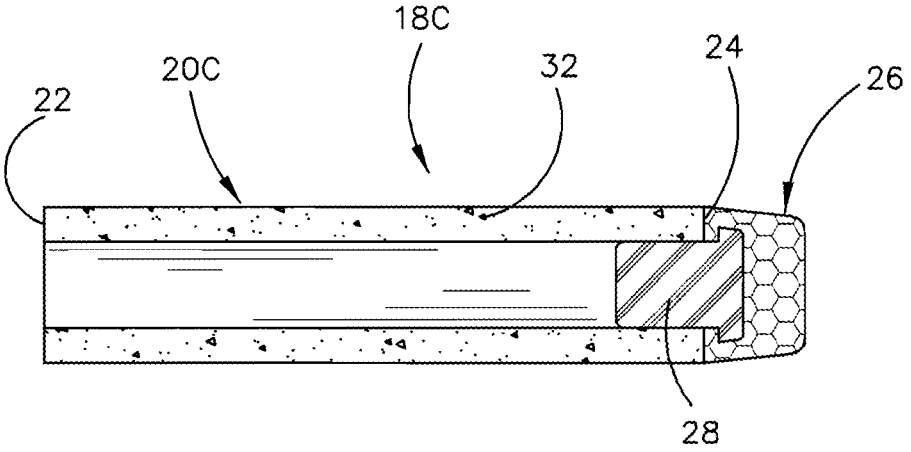
FIG. 7 is a sectional view of a further embodiment of a toy dart wherein the shaft of the dart has magnetic or magnetizable particles or fibers embedded in the shaft thereof.

FIG. 7 illustrates a third embodiment of the dart 18 and which is referred to by the reference numeral 18C. The tubular body portion 20C of dart 18C has magnetic or magnetizable particles 32 embedded therein.

Figure 8:
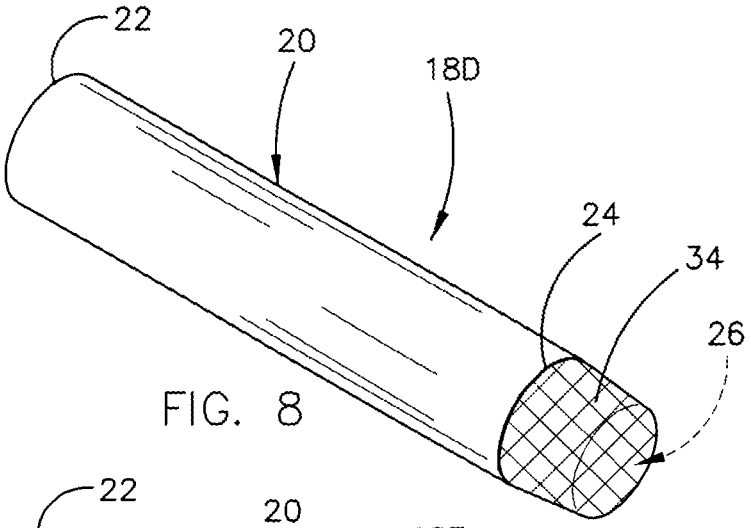
FIG. 8 is a perspective view of a further embodiment of a toy dart wherein the tip thereof is coated with a magnetic or magnetizable material.

FIG. 8 refers to a fourth embodiment of the dart 18 and which is referred to with the numeral 18D. The tip 26 is coated with a magnetic paint 34. The magnetic paint 34 may be sprayed onto tip 26B. The tip 26 could be coated with paint or by dipping the dart 18 into magnetic paint 34.

Figure 9:
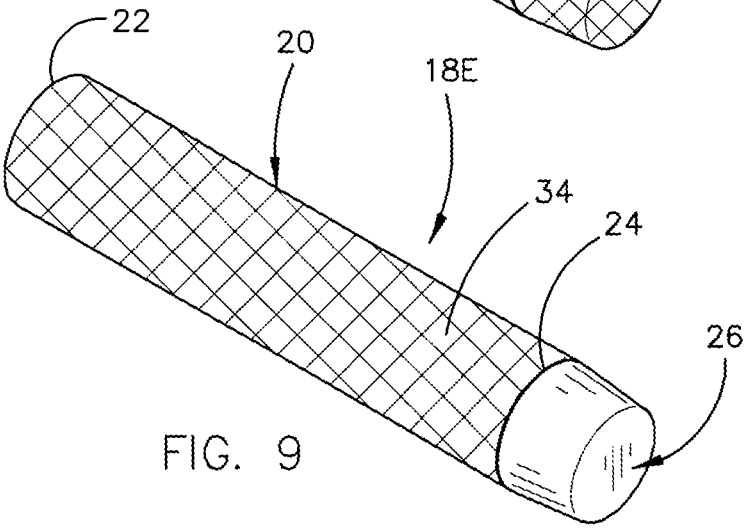
FIG. 9 is a perspective view of a further fifth embodiment of a toy dart wherein the shaft thereof is coated with a magnetic or magnetizable material.

FIG. 9 illustrates a fifth embodiment of the dart 18 and which is referred to with the reference numeral 18E. The tubular body portion 20 is coated with magnetic paint 34.

Figure 10:
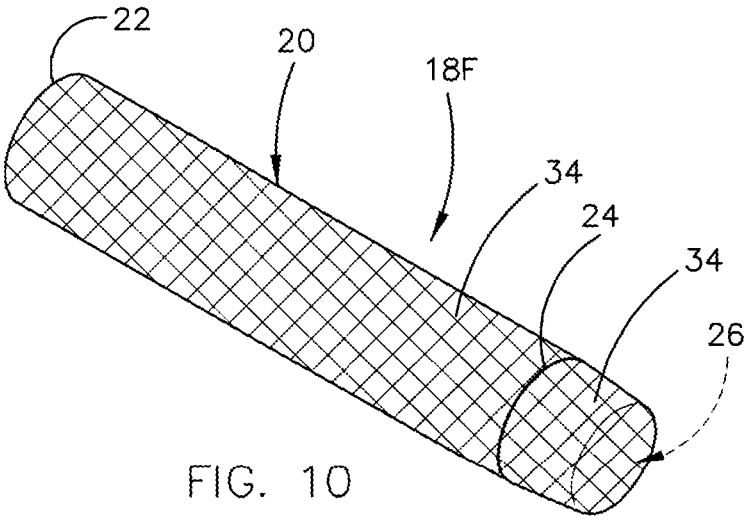
FIG. 10 is a perspective view of a further embodiment of a toy dart wherein the entire dart is coated with a magnetic or magnetizable material.

FIG. 10 illustrates a sixth embodiment of dart 18 and which is referred to by the reference numeral 20F. The tubular body portion 20 and the tip 26 are coated with magnetic paint 34.

Figure 1:
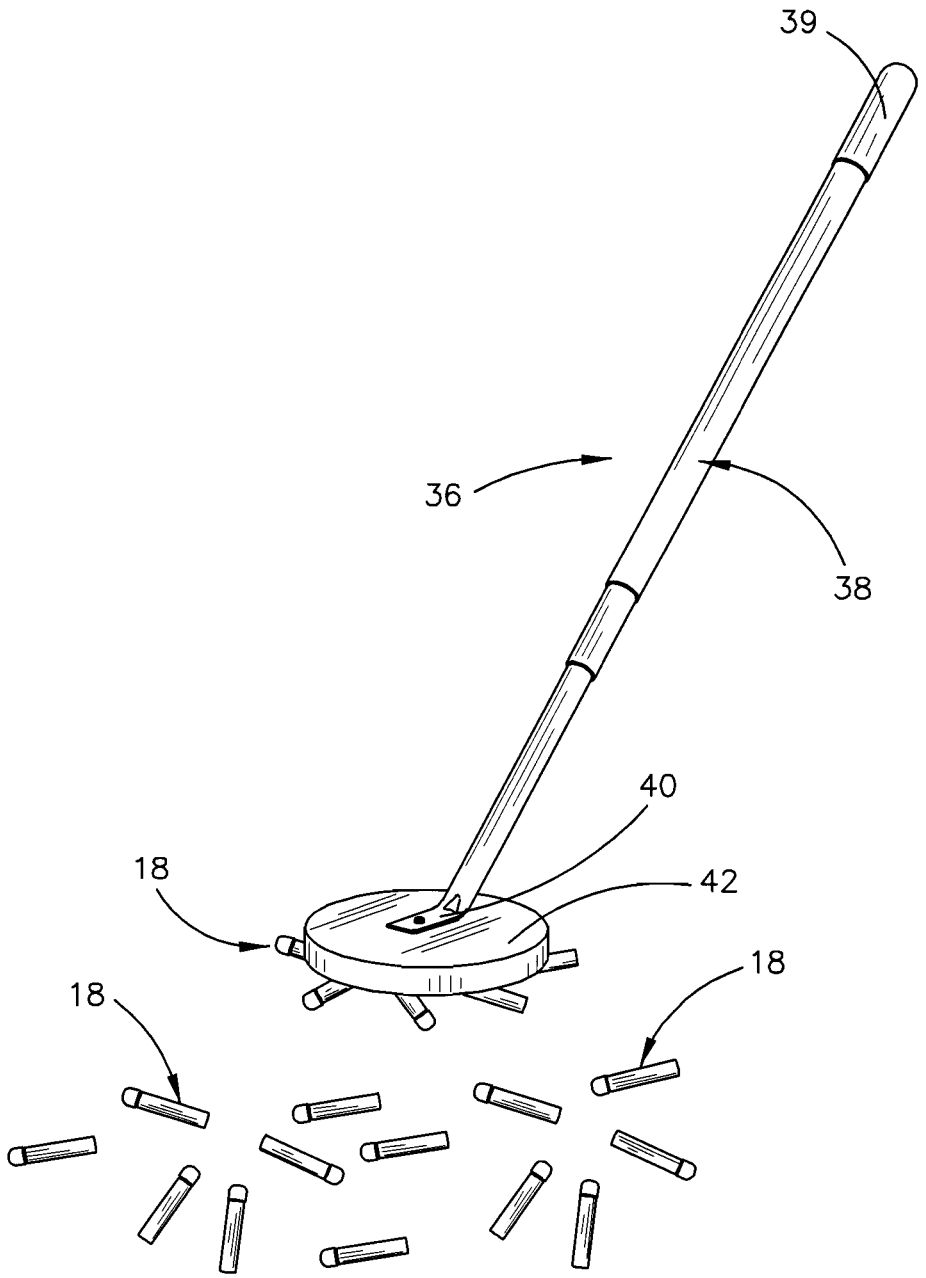
FIG. 1 is a perspective view of a device of this invention being used to pick up toy or hobby projectiles of this invention.

FIG. 1 is a perspective view of a device for picking up or gathering the projectiles after they have been fired from a pistol or rifle. The device of FIG. 1 is referred to generally by the reference numeral 36. Device 36 includes a telescopic handle 28 having an upper end 38 and a lower end 40. The lower end 40 of device 36 is attached to a disc-like member 42 which is comprised of a metal or magnetic material. The device 36 may be moved along a floor or the like where the spent toy projectiles are laying. The design of the member 42 permits it to be moved below furniture or the like. When the member 42 is brought into contact with the toy projectiles such as projectile 18, the toy projectile will magnetically be attached to the member 42 to provide a very convenient way to gather up the spent toy projectiles. The toy projectiles may be easily detached from the member 42. Although only projectiles 18 are shown in FIG. 1, the other projectiles will also be magnetically attached to the member 42 since they have magnets or magnetic material therein.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

What is claimed:

1. A hobby projectile including:

a body portion having an at least a partially foam material construction;

a tip portion operably coupled to the body portion, the tip portion including at least one of an elastomeric or plastic material construction; and a magnetic component at least partially coating at least one of the body portion or the tip portion.

2. The hobby projectile of claim 1 wherein said hobby projectile is a dart.

3. The hobby projectile of claim 1, wherein the tip portion includes:

the magnetic component at least partially coating the tip portion.

4. The hobby projectile of claim 1, wherein the body portion includes:

the magnetic component at least partially coating the body portion.

5. The hobby projectile of claim 1, wherein the magnetic component includes:

a magnetizable component.

6. The hobby projectile of claim 1, wherein the foam material construction of the body portion includes:

the magnetic component at least partially coating the foam material construction of the body portion.

7. The hobby projectile of claim 1, wherein the body portion includes:

a tubular body portion having an exposed aperture disposed in an end opposite the tip portion.

8. The hobby projectile of claim 1, wherein the body portion having an at least a partially foam material construction includes:

a tubular body portion having an at least a partially foam material construction.

9. The hobby projectile of claim 8, wherein the tubular body portion having an at least a partially foam material construction includes:

the magnetic component at least partially coating the tubular body portion having an at least a partially foam material construction.

10. The hobby projectile of claim 1, wherein the tip portion including at least one of an elastomeric or plastic material construction includes:

an elastomeric tip portion having a suction-cup configuration.

11. The hobby projectile of claim 1, wherein the tip portion including at least one of an elastomeric or plastic material construction includes:

an elastomeric tip portion having a side surface and an adjacent at least partially planar end surface.

12. A hobby projectile including:

a body portion having an at least a partially foam material construction;

a tip portion operably coupled to the body portion, the tip portion including at least one of an elastomeric or plastic material construction; and a magnetic component enveloped within the tip portion.

13. The hobby projectile of claim 12, wherein the magnetic component includes:

a magnetizable component.

14. The hobby projectile of claim 12, wherein the tip portion including at least one of an elastomeric or plastic material construction includes:

an elastomeric tip portion having a suction-cup configuration.

15. The hobby projectile of claim 12, wherein the tip portion includes:

tip portion having a side surface and an adjacent at least partially planar end surface.

16. A hobby projectile including:

a body portion having an at least a partially foam material construction;

a tip portion operably coupled to the body portion, the tip portion including at least one of an elastomeric or plastic material construction; and a magnetic component enveloped within the foam material construction of the body portion.

17. The hobby projectile of claim 16, wherein the body portion includes:

a tubular body portion having an exposed aperture disposed in an end opposite the tip portion.

18. The hobby projectile of claim 17, wherein the magnetic component enveloped within the foam material construction of the body portion includes:

the magnetic component enveloped within a wall defining the tubular body portion.

19. The hobby projectile of claim 18, wherein the tubular body portion includes:

a tubular body portion having an at least a partially foam material construction.

20. The hobby projectile of claim 19, wherein the magnetic component enveloped within a wall defining the tubular body portion includes:

a magnetic component enveloped within the wall defining the tubular body portion having an at least a partially foam material construction.

21. The hobby projectile of claim 16, wherein the magnetic component includes:

a magnetizable component.

22. The hobby projectile of claim 16, wherein the tip portion including at least one of an elastomeric or plastic material construction includes:

an elastomeric tip portion having a suction-cup configuration.

23. The hobby projectile of claim 16, wherein the tip portion includes:

a tip portion having a side surface and an adjacent at least partially planar end surface.

24. A hobby projectile including:

a body portion having an at least a partially foam material construction;

a tip portion including a shank portion insertable into a recess in the body portion, the tip portion having at least one of an elastomeric or plastic material construction; and a magnetic component operably coupled to at least one of the body portion or the tip portion, wherein the magnetic component is disposed at least partially within the shank portion.

* * * * *